US007269856B1

(12) United States Patent
Cannan

(10) Patent No.: US 7,269,856 B1
(45) Date of Patent: Sep. 18, 2007

(54) DRIBBLE BIB

(76) Inventor: Frances Marie Cannan, 3580 16th Ave. SE., Naples, FL (US) 34117-9157

( * ) Notice: Subject to any disclaimer, the term of this patent is extended or adjusted under 35 U.S.C. 154(b) by 0 days.

(21) Appl. No.: 11/485,162

(22) Filed: Jul. 12, 2006

(51) Int. Cl.
*A41B 13/10* (2006.01)

(52) U.S. Cl. ..... 2/49.1; 2/49.4

(58) Field of Classification Search ..... 2/49.1, 2/49.2, 49.5, 49.4, 49.3, 48, 51, 50, 52, 75, 2/80, 111; D2/860–864
See application file for complete search history.

(56) References Cited

U.S. PATENT DOCUMENTS

| | | | | | |
|---|---|---|---|---|---|
| 593,618 | A | * | 11/1897 | Stackhouse | 2/49.5 |
| 889,073 | A | | 5/1908 | Walbridge | |
| D155,752 | S | * | 10/1949 | Vivaudou | D2/862 |
| 2,552,462 | A | | 5/1951 | Savrin | |
| 2,571,888 | A | * | 10/1951 | Jesse | 2/49.1 |
| 2,835,895 | A | | 5/1958 | Wells | |
| D206,425 | S | * | 12/1966 | Faughnder | D2/864 |
| 3,608,092 | A | * | 9/1971 | Taranto | 2/49.1 |
| D345,852 | S | * | 4/1994 | Nelson | D2/861 |
| 5,432,952 | A | | 7/1995 | Tate | |
| 5,483,701 | A | | 1/1996 | Ferreyros | |
| 5,490,289 | A | | 2/1996 | Lehrer | |
| 5,666,665 | A | * | 9/1997 | Morgado | 2/49.1 |
| 6,408,439 | B1 | * | 6/2002 | Garforth-Crippen | 2/80 |
| 6,481,016 | B1 | | 11/2002 | Rees | |
| 6,490,731 | B1 | * | 12/2002 | Hyatt | 2/49.1 |
| 6,523,200 | B2 | * | 2/2003 | Brown | 5/639 |
| 6,732,375 | B2 | | 5/2004 | Nornes | |
| 6,836,899 | B1 | * | 1/2005 | Glasmire | 2/52 |
| 6,961,961 | B1 | * | 11/2005 | Ezra | 2/49.1 |
| 2004/0078862 | A1 | * | 4/2004 | Palant | 2/46 |
| 2004/0205876 | A1 | * | 10/2004 | Bruffett | 2/49.2 |
| 2005/0132462 | A1 | * | 6/2005 | Archambault | 2/48 |

* cited by examiner

*Primary Examiner*—Amy B. Vanatta
(74) *Attorney, Agent, or Firm*—The Livingston Firm; Edward M. Livingston; Angela M. Miller

(57) ABSTRACT

A dribble bib (1) having a chin section (2) that is located beneath the wearer's chin, a raised section (3) and a wiping section (4) that may be used to wipe the wearer's mouth. The raised section (3) contains a predetermined amount of filling (12) so extend the raised section (3) away from the dribble bib (1) so as to catch food, liquid and/or drool from the wearer's mouth. The back side (9) of the dribble bib (1) is preferably made of vinyl so as to prevent leakage of liquids and/or drool onto the wearer. In addition, the dribble bib (1) also preferably includes at least one adjustable means for fastening (6) so as to fit a wide range of neck sizes.

11 Claims, 1 Drawing Sheet

DRIBBLE BIB

BACKGROUND OF THE INVENTION

This invention relates to bibs, more particularly, a dribble bib having a raised section that catches food, liquid and/or drool from a wearer's mouth.

Currently there are a plethora of bibs having various shapes and styles that are used for babies and/or other intended wearers. Although all are intended to prevent food, liquid and/or drool from falling on the wearer's clothing or skin, they have one common flaw: the bibs themselves are substantially planar in shape so as to permit the food, liquid and/or drool to slide down the bib and onto the wearer.

Although there have been attempts to correct this significant flaw, such as the inclusion of a pocket located at the base of the bib, the fact remains that the food, liquid and/or drool still slides down the bib, thereby soiling a large area of the bib. In addition, depending on the amount of liquid and/or drool that falls onto the bib, the liquid and/or drool may absorb through the bib, thereby soiling the wearer's shirt or skin. Finally, although the inclusion of a pocket may assist in catching solid items, such as food particles, the pocket is not useful in collecting the liquid and/or drool unless a massive amount of liquid or drool falls on the bib wherein the bib portion is not able absorb the liquid and/or drool.

Thus, a need exists for a dribble bib having a raised section that catches food, liquid and/or drool from a wearer's mouth.

The relevant prior art includes the following references:

| Patent No. (U.S. unless stated otherwise) | Inventor | Issue/Publication Date |
|---|---|---|
| 5,490,289 | Lebrer | Feb. 13, 1996 |
| 2,552,462 | Savrin | May 8, 1951 |
| 2,835,895 | Wells | May 27, 1958 |
| 6,481,016 | Rees | Nov. 19, 2002 |
| 5,432,952 | Tate | Jul. 18, 1995 |
| 5,483,701 | Ferreyros | Jan. 16, 1996 |
| 6,732,375 | Nomes | May 11, 2004 |
| 889,073 | Walbridge | May 26, 1908 |

SUMMARY OF THE INVENTION

The primary object of the present invention is to provide a dribble bib that catches food, liquid and/or drool from a wearer's mouth.

A further object of the present invention is to provide a dribble bib that is comfortable to wear.

An even further object of the present invention is to provide a dribble bib that is easy to use.

A further object of the present invention is to provide a dribble bib that is attractive in appearance.

The present invention fulfills the above and other objects by providing a dribble bib having a chin section that is located beneath the wearer's chin, a raised section and a wiping section that may be used to wipe the wearer's mouth. The raised section is filled with a predetermined amount of a predetermined filling so as to extend away from the dribble bib and cup a chin area of the wearer from cheek to cheek. In this manner, the raised section is used to catch food, liquid and/or drool from the wearer's mouth. The back side of the bib is preferably made of vinyl so as to prevent leakage of liquids and/or drool onto the wearer. However, the back side of the bib may be of various other materials, such as cotton, as well. In addition, the bib also preferably includes at least one adjustable means for fastening so as to fit a wide range of neck sizes.

To use the present invention, the bib is secured around a wearer's neck via the at least one adjustable means for fastening. When worn, the chin section of the bib is located under the chin. The raised section extends away from the wearer so as to catch food, liquid and/or drool while cupping the chin are from cheek to cheek of the wearer. Then, if it is desired to wipe the food, liquid and/or drool off the face of the wearer, a person may use the wiping section to do so.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
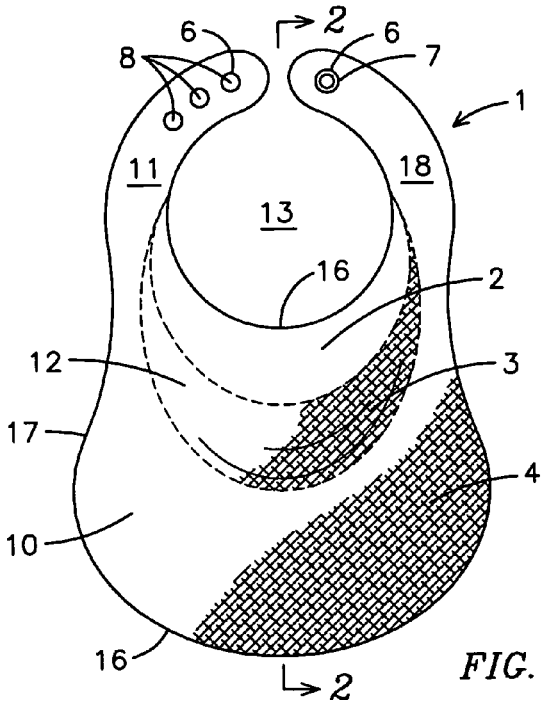
FIG. 1 is a front plan view of a first embodiment of the present invention.

For purposes of describing the preferred embodiment, the terminology used in reference to the numbered components in the drawings is as follows:

| | |
|---|---|
| 1. | dribble bib, generally |
| 2. | chin section |
| 3. | raised section |
| 4. | wiping section |
| 5. | stitch |
| 6. | means for fastening |
| 7. | button |
| 8. | button hole |
| 9. | back side |
| 10. | front side |
| 11. | first strap |
| 12. | filling |
| 13. | neck opening |
| 14. | hook fastening material |
| 15. | loop fastening material |
| 16. | perimeter |
| 17. | body |
| 18. | second strap |

With reference to FIG. 1, is a front plan view of a first embodiment of the present invention is shown. The dribble bib 1 includes a first strap 11 and a second strap 18 attached to a predeterminedly-sized body 17, a neck opening 13 and a chin section 2, raised section 3 and wiping section 4 located on the body 17. A means for fastening 6, which may be a button 7 located on the second strap 18 and at least one button hole 8 located on the first strap 11, permit for adjustable sizing of the dribble bib 1 about a wearer's neck.

A means for securing a front side 10 of the dribble bib 1 to a back side 9 of the dribble bib 1 is preferably by utilizing a perimeter 16 which is formed by sewing the front side 10 to the back side 9. The raised section 3 is crescent-shaped and created using a predetermined amount of filling 12, which is preferably cotton, to fill a predetermined area of the raised section 3 so as to maintain an elevated profile in comparison to the dribble bib 1. When worn, the crescent-shape of the raised section 3 is located beneath the chin and extends from cheek to cheek of the wearer so as to provide maximum protection from spills and drool.

Figure 2:
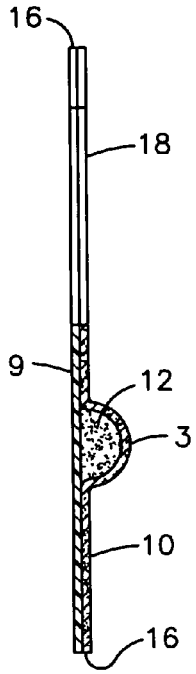
FIG. 2 is a cross-sectional view along line 2-2 of FIG. 1.

In FIG. 2, a cross-sectional view along line 2-2 of FIG. 1 is shown. The filling 12 is preferably made of an absorbent and soft material to permit the raised section 3 to extend away from the dribble bib 1. The front side 10 of the dribble bib 1 is made of a predetermined material, preferably a soft, absorbent material, such as terry cloth, while the back side 9 of the dribble bib 1 is also made of a predetermined material, preferably a liquid-resistant material, such as vinyl.

Figure 3:
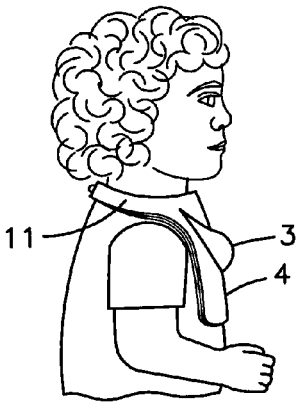
FIG. 3 is a side view of the first embodiment of the present invention in use.

Next, FIG. 3 shows a side view of the first embodiment of the present invention in use. When the dribble bib 1 of the present invention is worn, the raised section 3 is located below the chin and mouth area of a wearer and extends away from the wearer. Thus, when food, liquid and/or drool exits the wearer's mouth, the raised section 3 catches the food, liquid and/or drool. If food, liquid and/or drool remains on the wearer's mouth, chin or face, the wiping section 4 of the dribble bib 1 may be used to wipe/dry the wearer as the wiping section 4 should be dry and clean. In addition, because the back side 9 of the dribble bib 1 is preferably made of a liquid-resistant material, even if the entire front side 10 of the dribble bib 1 became wet, the liquid and/or drool will not entirely penetrate the dribble bib 1 as the liquid-resistant material will serve as a barrier between the liquid and/or drool and the wearer or the wearer's clothing.

Figure 4:
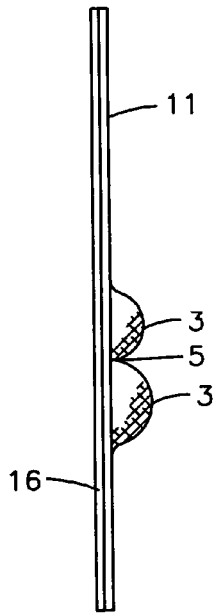
FIG. 4 is a side view of a second embodiment of the present invention.

With reference to FIG. 4, a side view of a raised embodiment of the present invention is shown. Rather than having one large raised section 3, the second embodiment of the present invention includes two raised sections 3. To create the dual raised sections 3, a stitch 5 may be used to separate the filling 12 so as to create two raised sections 3.

Figure 5:
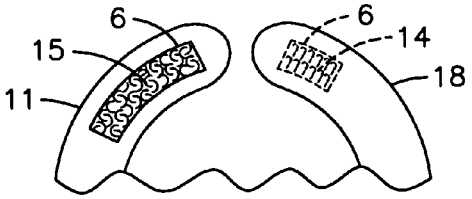
FIG. 5 is a front view of an alternate means for fastening the present invention around a wearer's neck.

Finally, FIG. 5 shows a front view of an alternate means for fastening the present invention around a wearer's neck. The means for fastening 6 could include at least one hook fastening material 14 located on the second strap 18 and at least one mating loop fastening material 15 located on the first strap 11. In addition, alternate means for fastening 6 could include snaps, clasps, hooks and any other means for fastening the straps 18 and 11 to one another.

Although not shown, the dribble bib 1 of the present invention need not include a chin section 2. It is most preferably to use a chin section 2, however, because the chin section 2 is located above the raised section 3, thereby adding a predetermined distance between the raised section 3 and the wearer's mouth. Therefore, the raised section 3 will not interfere with jaw movements of the wearer when eating or drinking when the dribble bib 1 includes the chin section 2.

The use of the present invention will assist in preventing food, liquid and/or drool from spilling down the entire length of the dribble bib 1, thereby maintaining a relatively clean area of the dribble bib 1 to be used for wiping purposes.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

I claim:

1. A dribble bib comprising:

a predeterminedly-sized body having a front side and a back side;

a first strap and a second strap attached to said body;

said front side having at least one crescent-shaped raised section that is located on and external to said front side and extends from said first strap to said second strap;

said front side having at least one wiping section;

said front side made of a predetermined material;

said back side made of a predetermined material;

means for securing said front side to said back side;

a predetermined amount of a predetermined filling is located within said at least one raised section; and a means for securing said first strap to said second strap; and a chin section of a predetermined size located above said raised section on said front side of said body.

2. The dribble bib claim 1 wherein:

said front side predetermined material is terry cloth.

3. The dribble bib of claim 1 wherein:

said back side predetermined material is vinyl.

4. The dribble bib of claim 1 wherein:

said means for securing said front side to said back side is by sewing.

5. The dribble bib of claim 1 wherein:

said means for securing said first strap to said second strap is a hook material located on said second strap and a loop material located on said first strap.

6. The dribble bib of claim 1 wherein:

said means for securing said first strap to said second strap is a button located on said second strap and at least one hole located on said first strap.

7. The dribble bib of claim 1 wherein:

said predetermined filling located within said at least one raised section is cotton.

8. The dribble bib of claim 2 wherein:

said back side predetermined material is vinyl.

9. The dribble bib of claim 8 wherein:

said means for securing said first strap to said second strap is a hook material located on said second strap and a loop material located on said first strap.

10. A dribble bib comprising:

a predeterminedly-sized body having a front side and a back side;

a first strap and a second strap attached to said body;

said front side having a chin section of a predetermined size;

said front side having at least one crescent-shaped raised section that is located on and external to said front side and located below said chin section;

said at least one raised section extends from said first strap to said second strap;

said front side having at least one wiping section located below said at least one raised section;

said front side is made of a terry cloth;

said back side is made of vinyl;

a means for securing said front side to said back side;

said means for securing said front side to said back side is by sewing;

a means for securing said first strap to said second strap wherein a hook material is located on said second strap and a loop material is located on said first strap; and a predetermined amount of a cotton is located within said at least one raised section.

11. A dribble bib comprising:

a predeterminedly-sized body having a front side and a back side;

a first strap and a second strap attached to said body;

said front side having a chin section of a predetermined size;

said front side having at least one crescent-shaped raised section that is located on and external to said front side and located below said chin section;

said at least one raised section extends from said first strap to said second strap;

said front side having at least one wiping section located below said at least one raised section;

said front side is made of terry cloth;

said back side is made of vinyl;

a means for securing said front side to said back side;

said means for securing said front side to said back side is by sewing;

a means for securing said first strap to said second strap;

said means for securing said first strap to said second strap is a button located on said second strap and at least one hole located on said first strap; and a predetermined amount of a cotton is located within said at least one raised section.

* * * * *